United States Patent [19]

Masunaga et al.

[11] 4,008,148

[45] Feb. 15, 1977

[54] METHOD FOR THE PREPARATION OF INSULATING OIL

[75] Inventors: Midori Masunaga, Tokyo; Yoshiki Kohno, Kawasaki; Tadashi Ohmori, Yokohama, all of Japan

[73] Assignee: Nippon Oil Company Ltd., Tokyo, Japan

[22] Filed: Apr. 30, 1975

[21] Appl. No.: 573,575

[30] Foreign Application Priority Data

Oct. 23, 1974 Japan ..... 49-121521

[52] U.S. Cl. ..... 208/211; 208/212; 208/213; 208/216; 208/217

[51] Int. Cl.[2] ..... C10G 34/00

[58] Field of Search ..... 208/87, 211, 96, 99, 208/212, 216

[56] References Cited

UNITED STATES PATENTS

| | | | |
|---|---|---|---|
| 2,967,144 | 1/1961 | Cole | 208/87 |
| 3,520,796 | 7/1970 | Murphy, Jr. et al. | 208/211 |
| 3,627,673 | 12/1971 | Sproule et al. | 208/211 |
| 3,849,288 | 11/1974 | Milstein et al. | 208/99 |

*Primary Examiner*—George Crasanakis

[57] ABSTRACT

This invention provides a method for the preparation of insulating oil having good oxidation stability, electric characteristics and resistance to copper corrosion which comprises subjecting a distillate (stock) within a temperature range from 250° to 400° C. in terms of the boiling point at atmospheric pressure to solvent refining to a desulfurization from 30 to 75% by weight to give a raffinate, said distillate having been obtained either by distillation at atmospheric pressure of a paraffin- or mixture-base crude oil and/or by distillation under reduced pressure of a residual oil from the atmospheric pressure distillation, subjecting said raffinate to hydrogenating refining to a desulfurization from 40 to 90% by weight and subjecting the refined product to solvent dewaxing, and if necessary, subsequently subjecting the dewaxed product to clay treatment to a sulfur content of the final product from 0.1 to 0.35% by weight.

6 Claims, 1 Drawing Figure

METHOD FOR THE PREPARATION OF INSULATING OIL

BACKGROUND OF THE INVENTION

1. Field of the Invention

This invention relates to a method for the preparation of insulating oil from a paraffin- or mixture-base crude oil.

More particularly, this invention is concerned with a method for the preparation of novel insulating oil having good oxidation stability, electric characteristics and resistance to copper corrosion which comprises subjecting a distillate within a temperature range from 250° to 400° C. in terms of the boiling point at atmospheric pressure to solvent refining to a desulfurization from 30 to 75% by weight to give a raffinate, said distillate having been obtained either by distillation at atmospheric pressure of a paraffin- or mixture-base crude oil or by distillation under reduced pressure of a residual oil from the atmospheric pressure distillation, subjecting said raffinate to hydrogenating refining to a desulfurization from 40 to 90% by weight and subjecting the refined product to solvent dewaxing, and if necessary, subsequently subjecting the dewaxed product to clay treatment to a sulfur content of the final product from 0.1 to 0.35% by weight.

2. Description of the Prior Art

A number of methods are known for the preparation of mineral insulating oil. Traditionally, insulating oils have been manufactured from naphthenic crudes. The prior art methods employing naphthene-base crude oil as the feedstock could not be used for the preparation of electric insulating oil with satisfactory properties from paraffin- or mixture-base crude oil.

Among these prior art methods there are mentioned those methods which involve sulfuric-acid treatment, solvent refining or hydrogenating refining followed by treatment with a solid adsorbent for removing impurities such as unsaturated hydrocarbons, asphalt materials, sulfur compounds and nitrogen compounds. With lower degrees of refining, these treatments would result in products with no improvement in resistance to copper plate corrosion and electric characteristics and higher degrees of refining are required. With a higher degree of refining, however, there will usually be induced too much removal of natural oxidation-inhibiting components originally present in mineral oil to produce insulating oil with good oxidation stability, the above-mentioned problems are improved. In this respect, addition of a specified proportion of a lowly refined oil to the highly refined oil has been proposed for the preparation of insulating oil with good electric characteristics and oxidation stability. In Japanese Patent Publication No. 2981/1960 is described a method for the preparation of electric insulating oil with high oxidation stability which comprises adding to the refined oil a polynuclear aromatic component separated by extraction from mineral oil. There is also described in Japanese Patent Publication No. 3589/1966 production of electric insulating oil with high oxidation stability by addition to the refined oil from hydrogenation of a raffinate containing aromatics in a proportion of 23% by weight or lower a lubricating oil with a higher content of aromatics in a proportion of 15% by weight or lower.

As described above, the insulating oil has heretofore been produced using good-quality naphthene-base crude oil as the feedstock. In recent years the continuing short supply of naphthenic crudes have created a need for production of insulating oil from paraffin- or mixture-base crude oil. On the other hand, application to paraffin- or mixture-base crude oil of the prior art methods for naphthene-base crude oil as they are does not produce insulating oil possessing good oxidation stability, electric characteristics and resistance to copper plate corrosion. The naphthene-base crude oil and paraffin- or mixture-base crude oil being quite different from each other in properties, this is unavoidable and novel methods must be developed for the preparation of insulating oil from paraffin- or mixture-base crude oil. It is to be noted, for example, that when a paraffin- or mixture-base crude oil is treated in the same way as described in Experiment A in Example 1 of Japanese Patent Publication No. 18584/1961 using hydrogenating refining and clay treatment there will not be produced electric insulating oil with high corrosion resistance and oxidation stability.

SUMMARY OF THE INVENTION

This invention relates to a method for the preparation of insulating oil starting not with naphthene-base crude oil but with paraffin- or mixture-base crude oil. Furthermore, it is concerned with a method for the preparation of such an insulating oil that has good oxidation stability, electric characteristics and resistance to copper corrosion.

After extensive investigations into production of insulating oil with good oxidation stability, electric characteristics and resistance to copper corrosion we have found the method of this invention. "Paraffin-base crude oil" as used herein means crude oil containing much paraffinic hydrocarbons, in which, as set forth on page 19 of "Sekiyu Binran (Petroleum Manual)", Sekiyu Sjunjū Publishing Co. 1972, the first key distillate (kerosene distillate) has an API specific gravity of 40° or higher and the second key distillate (lubricating oil distillate boiling between 275° and 300° C. at 40 mm.Hg) has an API specific gravity of 30° or higher. Typical of the crude oil are Pennsylvania crude oil and Minas crude oil. "Mixture-base crude oil" as used herein is the intermediate between the paraffin- and naphthene-base crude oils, in which the first key distillate has an API specific gravity from 33° to 40° and the second key distillate has an API specific gravity from 20° to 30°, and is often found in Middle East crude oils including Midcontinent, Arabia and Kafji crude oils. Preferred are Arabia crude oils such as Arabian Medium and Arabian Light in the present invention.

BRIEF DESCRIPTION OF THE DRAWING

In the accompanying drawing

DESCRIPTION OF THE INVENTION

Figure 1:
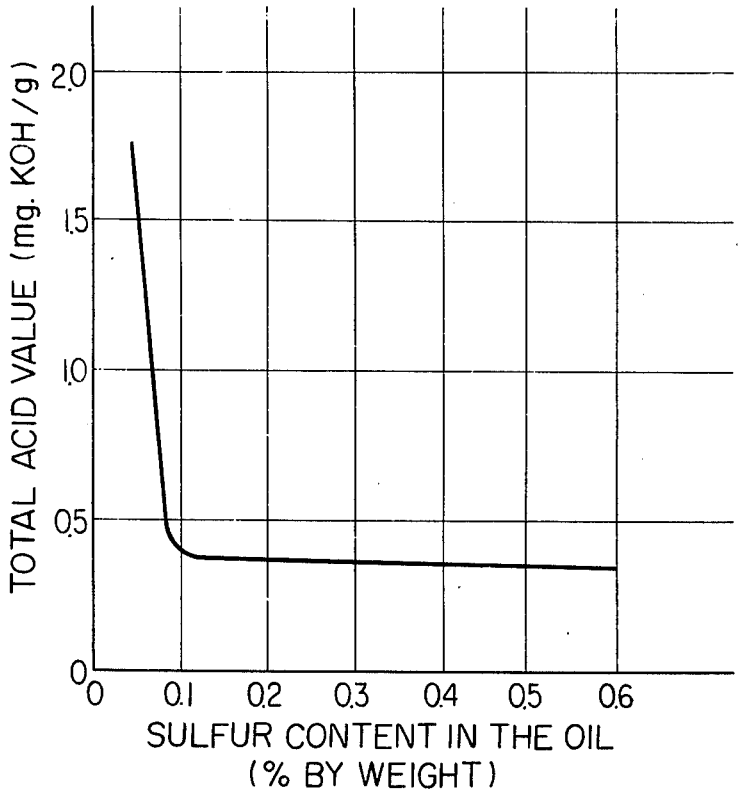
FIG. 1 shows the relationship between the sulfur content in paraffin- and mixture-base insulating oils and the total acid value in the JIS oxidation stability test.

According to the present invention, a distillate within a temperature range between 250° and 400° C. in terms of the boiling point at atmospheric pressure, which has been obtained either from distillation at atmospheric pressure of paraffin- or mixture-base crude oil or from distillation under reduced pressure of a residual oil from the atmospheric pressure distillation, is treated with a solvent selectively dissolving aromatic compounds to remove 30–75% by weight of the sulfur present in the feedstock oil. The solvents employed herein which selectively dissolves aromatic compounds are illustrated by furfural, liquid sulfur dioxide and phenol. Particularly preferable in this invention is furfural, with which the temperature for the extraction is usually from 50° to 100° C. and preferably from 60° to 90° C. The furfural is used at a furfural-mineral oil ratio in the range from 0.3 to 2.0, preferably from 0.5 to 1.7. A raffinate from the solvent extraction is then subjected to hydrogenating refining to remove 40–90% by weight of the sulfur contained in the raffinate. As the catalyst used in the hydrogenating refining are mentioned oxides of at least one metal of Groups VI, IB and VIII in the Periodic Table carried on bauxite, active carbon, fuller's earth, diatomaceous earth, zeolite, silica, silica alumina or the like, which are used with preliminary sulfurization applied. Exemplary of these oxides are cobalt, molybdenum, tungsten and nickel oxides and the like. Particularly preferable in the invention is a catalyst consisting of nickel oxide and molybdenum oxide carried on an aluminum-containing carrier which has been preliminarily sulfurized. The reaction temperature in the hydrogenating refining according to the invention is usually from about 230° to about 350° C., and preferably from 260° to 320° C. The reaction rate is lower at lower temperatures, whereas higher temperatures induce decomposition with increased paraffin component and somewhat higher pour point as well as inferior color of the product accompanied. The reaction pressure is 25 kg./cm.$^2$ or higher, preferably from 25 to 100 kg./cm.$^2$ and most preferably from 35 to 45 kg./cm.$^2$ The hydrogen is contacted at a rate in the range from 100 to 10,000 Nm.$^3$, preferably from 200 to 1,000 Nm.$^3$ Subsequently, solvent dewaxing is carried out in order to provide a predetermined pour point. The purpose of the dewaxing in this invention is the removal by solidification of the wax content in the oil by one of the known methods, which is usually by BK process. As the solvent used for the dewaxing are mentioned solvent mixtures such as benzene-toluene-acetone and benzene-toluene-methyl ethyl ketone. Composition of the solvent, that is, ratio of the ketone component to the aromatic component is suitably around 30–35% with acetone and 45–50% with methyl ethyl ketone. The relative amount of the solvent may be determined in such a way that the solvent is added to provide a nearly constant viscosity of the solution fed to the dewaxing filter. The solvent dewaxing may be carried out at any stage in the present invention but preferably following the hydrogenating refining. Clay treatment, which is subsequently applied, if necessary, is usually the finishing step for the preparation of insulating oil, whereby contact with active clay is made at 60°–80° C. for about 30 minutes to 1 hour followed by filtration.

We have now found that insulating oil having good oxidation stability, electric characteristics and resistance to copper corrosion can be produced by a method using paraffin- or mixture-base crude oil as the starting material which comprises solvent refining, hdyrogenatinng refining and solvent dewaxing and further clay treatment to a sulfur content in the final product from 0.1 to 0.35% by weight. It is seen from FIG. 1 which shows the relationship between the sulfur content in paraffin- or mixture-base insulating base oil and the oxidation stability that the higher the sulfur content, the better will be the oxidation stability. The figure also indicates that sulfur content below 0.1% by weight unexpectedly induces rapid reduction of the oxidation stability. It is evident from the fact that, in order to provide good oxidation stability in the production of insulating oil from paraffin- or mixture-base crude oil according to the present invention, the sulfur content must be at least 0.1% by weight. On the other hand, copper blackening phenomenon, a recent issue inside the transformer, which frequently occurs upon the surface of movable contact for no-voltage tap changer and induces an accident in the transformer, has been investigated by us in relation with the sulfur content in the paraffin- and mixture-base insulating oil to find that when the latter is 0.35% by weight or lower deterioration of electric characteristics of the former is extremely small and, in addition, amount of the sulfur attached to the surface of copper plate becomes small so that excellent insulating oil can be produced from paraffin- or mixture-base crude oil. See Examples and Comparative Examples below as for the embodiments. These facts indicate that sulfur content plays an important role in paraffin- and mixture-base insulating oil for its oxidation stability, electric characteristics and resistance to copper corrosion. We have thus found that definition of the sulfur content in the oil within the range from 0.1 to 0.35% by weight could be the only means for producing excellent insulating oil from paraffin- or mixture-base crude oil.

This invention is additionally characterized by solvent refining of a distillate for said insulating oil to a desulfurization of the sulfur content in said distillate from 30 to 75% by weight, preferably from 50 to 70% by weight and further refining by hydrogenation of the desulfurized raffinate to a desulfurization of the sulfur in said raffinate from 40 to 90% by weight, preferably from 60 to 80% by weight, thereby providing a sulfur content in the final product from 0.1 to 0.35% by weight. As shown in the comparative examples given below, when a raffinate with a desulfurization less than 30% by weight made in the solvent refining is hydrogenatively refined, the insulating oil with good oxidation stability is not produced.

A desulfurization more than 75% by weight in the solvent refining step will result not only in a too low yield of the raffinate for commercial practice but also in a too much reduction of the aromatic content in the raffinate to provide a satisfactory pour point of the insulating oil product. Anti-corona property, specific dispersion and hydrogen gas absorption are also inferior.

Also, a desulfurization more than 90% by weight in the hydrogenating refining step will lower oxidation stability of the product. On the other hand, a desulfurization less than 40% by weight in the hydrogenating refining will necessitate a higher ratio of the desulfurization in the solvent refining in order to maintain the sulfur content of the product within a predetermined range, which is commercially disadvantageous as described above.

An optimum aromaticity is claimed to be in the insulating oil in view of an important role of the proportion of aromatic component in the oil with reference to oxidation stability. This implies aromatic compounds being the effective component in natural antioxidants. The effect is recognized in patent literature including Japanese Patent publication Nos. 2981/1961, 18584/1961 and 3589/1966. Whereas there is claimed an optimum aromaticity in the naphthene insulating oil for the oxidation stability, or alternatively the oxidation stability is claimed to be due to both aromatic and sulfur compounds, it has been found bv us that, with paraffin- and mixture-base insulating oils, specified sulfur contents, not optimum aromaticity, produce good effects upon the oxidation stability, electric characteristics and resistance to copper corrosion. This invention has been completed on the basis of this finding.

DESCRIPTION OF PREFERRED EMBODIMENTS

The examples which follow are submitted to illustrate and not to limit this invention.

EXAMPLE 1

A distillate (b.p./atmospheric pressure 250°–400° C., sulfur content 1.8% by weight) was produced by distillation under reduced pressure of a residual oil obtained from distillation at atmospheric pressure of Middle East (mixture-base) crude oil. (Arabian Medium crude oil.) The distillate was then extracted with furfural at a solvent ratio (furfural/distillate oil) of 1.3 at an extraction temperature from 70° to 95° C. to give a raffinate with a sulfur content of 0.8% by weight (Ratio of desulfurization 56% by weight). The raffinate was further refined by hydrogenation at 300° C. and a hydrogen pressure of 40 kg./cm.$^2$ in the presence of an NiO-$MoO_3$ catalyst carried on alumina (NiO : 3.0% by weight, $MoO_3$ : 14.0% by weight), followed by dewaxing with benzene-toluene-methyl ethyl ketone solvent at a solvent ratio (solvent/oil) of 1.6 at a cooling temperature of −30° C. There was obtained an insulating oil with a pour point of −27.5° C. and a sulfur content of 0.16% by weight. JIS oxidation stability test (120° C., 75 hrs.) revealed that the acid value was 0.35 mg. KOH/g. and the sludge content was 0.08%. (Specification according to JIS 2320-1974 : Acid value 0.60 or lower, sludge content 0.40 or lower).

EXAMPLES 2 – 7 AND COMPARATIVE EXAMPLES 1 – 4

A distillate (b.p./atmospheric pressure 250°–400° C., sulfur content 2.0% by weight) obtained by distillation under reduced pressure of a residual oil from distillation at atmospheric pressure of Arabian Medium crude oil was subjected to solvent refining (furfural extraction) and hydrogenating refining respectively under different conditions. The products were then subjected to a solvent dewaxing under the same conditions as in Example 1 followed by a clay treatment at 70° C. for 1 hour. Conditions for respective treatment and results of JIS stability tests are shown in Table 1. As seen from Table 1, there is no corrolation between aromatic content of the product and oxidation stability, thereby indicating the absence of optimum aromaticity for oxidation stability as with the naphthene insulating oil. As evidently shown in Comparative Examples 1–3, sulfur contents of the product below 0.1% by weight induced unsatisfactory oxidation stability. Those of 0.1% by weight and above only produced the insulating oil with good oxidation stability.

Table 1

Middle East insulating oil and JIS stability

| Example and Comparative Example | Solvent refining: Solvent ratio | Solvent refining: Extraction temp. (° C.) | Solvent refining: Desulfurization ratio (wt. %) | Solvent refining: Sulfur content in raffinate (wt. %) | Hydrogenating refining: Catalyst | Hydrogenating refining: Reaction temp. (° C.) | Hydrogenating refining: Hydrogen pressure (kg/cm²) | Hydrogenating refining: LHSV | Property of product: Desulfurization ratio (wt. %) | Property of product: Sulfur content (wt. %) | Property of product: Aromatic content (wt. %) | Property of product: JIS stability (120° C., 75 hrs.) Total acid value (mgKOH/g) | Property of product: JIS stability (120° C., 75 hrs.) Sludge (%) |
|---|---|---|---|---|---|---|---|---|---|---|---|---|---|
| Example 2 | 1.0 | 60–90 | 52.5 | 0.95 | NiO-$MoO_3$ | 280 | 40 | 0.5 | 67 | 0.31 | 32 | 0.35 | 0.16 |
| 3 | " | " | " | " | " | 300 | " | 1.5 | 76 | 0.23 | 31 | 0.37 | 0.14 |
| 4 | " | " | " | " | " | 340 | " | 1.0 | 88 | 0.11 | 28 | 0.38 | 0.13 |
| Comparative Example 1 | " | " | " | " | " | 360 | " | 0.5 | ≥ 95 | ≤ 0.05 | 21 | 2.1 | 0.32 |
| 2 | " | " | " | " | " | " | " | 1.5 | 95 | 0.05 | 27 | 1.52 | 0.18 |
| Example 5 | 1.2 | " | 55 | 0.90 | " | 280 | " | 1.0 | 68 | 0.34 | 26 | 0.36 | 0.12 |
| 6 | 1.3 | " | 57.5 | 0.85 | " | 320 | " | 1.5 | 88 | 0.10 | 22 | 0.39 | 0.07 |
| 7 | 1.5 | " | 62.5 | 0.75 | " | 270 | " | 0.5 | 76 | 0.18 | 19 | 0.37 | 0.15 |
| Comparative Example 3 | " | " | " | " | " | 370 | " | 1.5 | ≥ 93 | ≤ 0.05 | 18 | 4.2 | 0.40 |
| 4 | 1.8 | " | 67.5 | 0.65 | " | 240 | " | " | 35 | 0.42 | 18 | 0.28 | 0.14 |

EXAMPLE 8

In a 500 c.c. glass vessel was placed 300 c.c. of an aliquot of the oil respectively from Examples 2, 5 and 6 and Comparative Examples 2 and 4. After each vessel was filled with nitrogen and sealed, a voltage stress test was conducted under 10 kv/2mm. at 100° C. for 10 days. The result are shown in Table 2. With sulfur contents less than 0.35% by weight, good results were obtained with small deterioration of electric characteristics induced and small amount of the sulfur attached on the copper plate used as the electrode. On the other hand, with larger sulfur contents, for example 0.42% by weight, larger deterioration of electric characteristics and remarkably increased amount of the sulfur attached on the electrode were observed. Another test under the same conditions with no voltage stress applied was carried out with similar results.

Table 2

| Results of voltage stress tests | | | | | |
|---|---|---|---|---|---|
| Oil sample | Sulfur content of product (wt. %) | Amount of sulfur attached to tested copper piece (mg.) | | Tans δ of tested oil (80° C.)(%) | |
| | | Without voltage stress | With voltage stress | Without voltage stress | With voltage stress |
| Comparative Example 2 | 0.05 | 1.8 | 4.0 | 0.03 | 0.04 |
| Example 6 | 0.10 | 1.5 | 3.5 | 0.04 | 0.05 |
| Example 2 | 0.31 | 1.6 | 3.7 | 0.03 | 0.05 |
| Example 5 | 0.34 | 1.9 | 4.1 | 0.03 | 0.07 |
| Comparative Example 4 | 0.42 | 3.5 | 15.1 | 0.06 | 0.4 |

As clearly seen from the results in Examples 1 – 8 and Comparative Examples 1 – 4, sulfur contents of the products from 0.1 to 0.35% by weight only provide insulating oils with excellent properties.

EXAMPLE 9

The same feedstock as in Example 1 was extracted with furfural at a solvent ratio of 1.7 and an extraction temperature of 70° – 95° C. to give a raffinate with a sulfur content of 0.7% by weight. The raffinate was then refined by hydrogenation at 270° C. and a hydrogen pressure of 45 kg./cm.$^2$ in the presence of an NiO — $WO_3$ catalyst carried on alumina (NiO : 5.1% by weight, $WO_3$ : 19.8% by weight), followed by dewaxing with a benzene-toluene-methyl ethyl ketone catalyst. The solvent ratio was 1.6 and the cooling temperature was −30° C. Finally low temperature clay treatment was made at a clay concentration of 2% and 60° C. to produce and insulating oil with a sulfur content of 0.25% by weight and a pour point of −27.5° C. JIS oxidation stability test was conducted with the oil to find that the total acid value was 0.31 mg KOH/g. and the sludge content was 0.07%.

COMPARATIVE EXAMPLE 5

The same starting oil as in Example 1 was finished without solvent refining by hydrogenating refining, solvent dewaxing and clay treatment. The hydrogenating refining was carried out using the same catalyst as in Example 1 at 360° C. and an LHSV of 0.7 to provide a sulfur content of 0.21% by weight in the product. JIS oxidation stability test was conducted to find the total acid value to be 1.4 mg. KOH/g. Electric characteristics were also inferior. It follows that the hydrogenating refining only did not produce the excellent insulating oil even with a sulfur content of about 0.2% by weight.

COMPARATIVE EXAMPLE 6

The same feedstock as in Example 1 was extracted with furfural at a solvent ratio of 0.25 and an extraction temperature of 60° – 90° C. to give a raffinate with a sulfur content of 1.5% by weight (Ratio of desulfurization 25% by weight). The raffinate was refined using the same catalyst as in Example 1 at 340° C. and a hydrogen pressure of 40 kg./cm.$^2$, followed by the same dewaxing as in Example 1 to give an insulating oil with a sulfur content of 0.13% by weight (Ratio of desulfurization 92% by weight). The insulating oil was unsuitable for practical use with an unsatisfactory acid value of 1.1 mg. KOH/g. An insulating oil with a sulfur content of 0.2% by weight (Ratio of desulfurization 87%) was also produced by similar hydrogenating refining and dewaxing treatments, which had an unsatisfactory total acid value of 0.8 mg.KOH/g. Using raffinates subjected to a desulfurization less than 30% by weight, there were obtained products with a sulfur content approximately from 0.1 to 0.2% by weight, which were not estimated to be an excellent insulating oil.

COMPARATIVE EXAMPLE 7

A distillate (b.p./atmospheric pressure 260° – 410° C., sulfur content 0.58% by weight) was prepared by distillation under reduced pressure of a naphthene-base crude oil. The distillate was then extracted with furfural at a solvent ratio of 1.0 and an extraction temperature of 60° – 90° C. to give a raffinate with a sulfur content of 0.30% by weight (Ratio of desulfurization 48% by weight) and an aromatic content of 21% by weight, which was then refined by hydrogenation at 280° C., a hydrogen pressure of 50 kg./cm.$^2$ and an LHSV of 1.5 and finally treated with clay to give an insulating oil with a sulfur content of 0.14% by weight and an aromatic content of 20% by weight. JIS oxidation stability test of the oil revealed that the total acid value was 0.91 mg.KOH/g. and the sludge content was 0.32%. As shown above, the solvent refining, hydrogenating refining and clay treatment within the scope of the treating conditions according to the present invention applied to a naphthene-base crude oil did not produce good insulating oil.

We claim:

1. Method for the preparation of insulating oil having good oxidation stability, electric characteristics and resistance to copper corrosion which comprises subjecting a distillate within a temperature having a boiling range from 250° to 400° C. at atmospheric pressure to solvent refining to provide a raffinate oil in which 30 to 75% by weight of the sulfur present in the distillate is removed in said solvent refining step, said distillate having been obtained from a paraffin base crude oil or mixture base crude oil, subjecting said raffinate to hydrogenating refining with hydrogen and a hydrogenation catalyst to reduce from 40 to 90% by weight of the sulfur present in the raffinate and subjecting said hydrogenated oil to solvent dewaxing to provide said insulating oil having a sulfur content from 0.1 to 0.35 percent by weight.

2. Method according to claim 1 wherein the solvent used for the solvent refining is one member selected from the group consisting of furfural, liquid sulfur dioxide and phenol.

3. Method according to claim 1 wherein the hydrogenating refining of the raffinate is carried out at a temperature from 230° to 350° C. under a pressure from 25 to 100 kg./cm.$^2$ using as the catalyst oxides of at least one metal selected from the group consisting of metals of Groups VI, IB and VIII in the Periodic Table on a carrier selected from the group consisting of bauxite, active carbon, fuller's earth, diatomaceous earth, zeolite, silica and silica-alumina.

4. Method according to claim 1 wherein the solvent used for the solvent dewaxing is a benzene-toluene-acetone solvent mixture or a benzene-toluene-methyl ethyl ketone solvent mixture.

5. Method according to claim 1 wherein the clay treatment is carried out with active clay at a temperature from 60° to 80° C. for a contact period of time from 30 minutes to 1 hour.

6. The method of claim 1, wherein the dewaxed product is subjected to a clay treatment to provide a final product having a sulfur content of from 0.1 to 0.35% by weight.

* * * * *